United States Patent [19]

Pierpoline

[11] 3,966,355

[45] June 29, 1976

[54] STEAM TURBINE EXTRACTION SYSTEM

[75] Inventor: Mario F. Pierpoline, Media, Pa.

[73] Assignee: Westinghouse Electric Corporation, Pittsburgh, Pa.

[22] Filed: June 24, 1975

[21] Appl. No.: 589,978

[52] U.S. Cl. ..... 415/144; 415/168

[51] Int. Cl.[2] ..... F01D 17/00

[58] Field of Search ..... 415/144, 145, 168, DIG. 1

[56] References Cited

UNITED STATES PATENTS

| | | | |
|---|---|---|---|
| 2,121,645 | 6/1938 | Warren | 415/144 |
| 2,738,921 | 3/1956 | Hausmann | 415/144 |
| 2,848,155 | 8/1958 | Hausmann | 415/144 |
| 2,906,089 | 9/1959 | Kaolosch et al. | 415/144 |
| 2,958,456 | 11/1960 | Forshaw | 415/144 |
| 3,398,881 | 8/1968 | Greenberg et al. | 415/144 |
| 3,597,106 | 8/1971 | Anderson | 415/144 |
| 3,632,223 | 1/1972 | Hampton | 415/144 |
| 3,777,489 | 12/1973 | Johnson et al. | 415/144 |

*Primary Examiner*—Henry F. Raduazo
*Attorney, Agent, or Firm*—G. H. Telfer

[57] ABSTRACT

An extraction system for extracting steam from the blade path of an axial flow turbine apparatus in a circumferentially uniform manner. Steam is extracted through an extraction orifice having a circumferentially-varying throat portion, the throat communicating with a diffusing passage leading into a circumferentially-extending extraction manifold. The manifold is connected to an extraction pipe of predetermined cross-section area. Steam extracted from the blade path is conducted through the extraction pipe to an associated user apparatus. The dimension of the throat in the longitudinal plane relative to the axis of the shaft and the radial dimension of the manifold in a plane normal to the shaft axis are sized and cooperatively related such that steam is uniformly extracted from the blade path without creating significant pressure variations at various circumferential locations therewithin.

13 Claims, 4 Drawing Figures

STEAM TURBINE EXTRACTION SYSTEM

BACKGROUND OF THE INVENTION

1. Field of the Invention

This invention relates to steam turbine apparatus, and in particular, to extraction systems for extracting steam from the blade path of the steam turbine to an associated user apparatus.

2. Description of the Prior Art

As is well known, the steam turbine apparatus comprises a rotating shaft having a plurality of arrays of rotating blades thereon. Surrounding the bladed rotor structure is a suitable casing having depending therefrom a plurality of arrays of stationary blades disposed in an alternating relationship with the rotating blades mounted on the shaft. The casing confines and guides a suitable motive fluid, such as steam, through the alternating arrays of stationary and rotating blades in order to extract energy from the steam and convert it into rotational mechanical energy.

The steam turbine is usually connected within a power plant comprising a closed loop arrangement including a steam generator and condenser. The turbine shaft is connected to an electrical generator element which generates electrical power for an associated load. It has been found and is well known in the art that the power plant operates most economically if arrangements are provided for raising the temperature of the liquid condensate prior to its introduction into the steam generator element. For this purpose, suitable feedwater heaters are provided within the system. Also, other economic considerations impel the use of various other associated apparatus within the power plant in order to enhance the efficiency thereof.

These associated apparatus, especially the feedwater heaters, derive their heat source from the extraction of steam from within the turbine apparatus to be placed in a heat exchange relationship within the heater in order to increase the temperature of the feedwater. Therefore, there is provided several extraction zones within the turbine casing at various axial locations along the blade path in order to extract steam at various pressures and temperatures from the blade path.

The present system of extraction disposes an extraction orifice at the periphery of the blade path in a location such that the axis of the orifice is perpendicular to the axis of the turbine shaft. The orifice communicates with an extraction manifold which is disposed generally circumferentially about the casing radially outward of the extraction orifice. The manifold volume is radially constricted within the area of the horizontal joints along the horizontal centerline of the turbine casing. The mainfold is itself connected to a suitable extraction conduit which conducts the steam extracted from the blade path to the associated user apparatus.

Other extraction strategies presently utilized by the prior art include the simple expedient of placing an opening within the base of the turbine casing communicating with the blade path. The extraction pipe is directly connected to the opening provided and in this manner motive steam is extracted for use in the associated apparatus.

In general, each of the above-cited extraction systems generates severe problems which deleteriously affects reliability of the rotating blades and, in an interrelated manner, deleteriously affects the efficiency of the overall power plant. Both the case of the circumferential manifold having the radial constriction in the area of the horizontal centerline and the expedient which simply disposes the extraction opening in the base of the turbine result in a non-uniformity of extraction of steam from the blade path. It is known that a large percentage of the extraction flow carried by the extraction conduit is taken from the base of the cylinder and therefore through the lower half of the turbine blade path, while the remaining extraction flow is obtained from the cover portion of the blade path.

Such large non-uniform pressure extractions exposes the rotating blades to great static pressure differences between the pressure upstream of the rotating blade and the pressure downstream of the rotating blade in the cover portion and between the pressure of the fluid upstream of the rotating blade and the pressure downstream of the rotating blade in the base portion. That is to say, since the motive fluid pressure at the exit of the stage upstream of the rotating blade row from which steam is extracted is substantially uniform over the entire circumference of the blade path and since the pressure field downstream of the rotating blade row is distorted by the non-uniformity of extraction, one can easily appreciate that cyclic load is imposed upon the rotating of blades due to a disparity of downstream pressure in the cover and in the base. Such cyclic force imposition on the rotating blade results in a probability of blade unreliability and failure.

Interrelated to the problem of blade reliability generated by the disparity between cover and base pressure is the dimunition of operating efficiency both of the turbine itself and of the overall power plant in which the turbine is disposed. Within the turbine, either of present extraction modes, due to the large pressure disparity, create vortices which lead to losses which cannot be made up in the arrays downstream of the affected zone. Of course, such vortices may combine with the cyclic force variation to increase the possibility of blade failure.

Present systems generate losses within the extraction system which results in a lowering of the pressure of the fluid delivered to the associated user apparatus. Therefore, in the case of a heater, more steam is required to be extracted from the turbine system in order to meet the pressure demands imposed on the blade path by the heater. Therefore, more steam is of necessity extracted from the blade path with a concomitant reduction in turbine efficiency. Thus, the overall efficiency of the power plant is deleteriously affected. Thus, in order to eliminate harmful cyclic force variations imposed on the rotating blade an improved extraction system is required. Also, in this age of increased attention to energy generation, an increase in efficiency in overall electrical generation systems is imperative. It is therefore incumbent that efficiency of the overall power plant be increased by the expedient of increasing efficiency of each constituent part of the plant. Thus, from the standpoint of energy conservation, it is imperative that a more efficient extraction system be provided.

SUMMARY OF THE INVENTION

This invention relates to a steam turbine extraction system for taking steam at a predetermined pressure and temperature from within the blade path of the steam turbine apparatus for use in an associated user apparatus, such as a feedwater heater with a minimum of pressure loss. The turbine includes a rotor having a plurality of arrays of rotating and stationary blades with a casing circumferentially disposed thereabout. A plurality of arrays of stationary blades depend from the casing and are alternately disposed between the arrays of rotating blades mounted on the rotor to define the annular blade path within the turbine. An extraction orifice is located circumferentially about the casing at a location axially intermediate between the trailing edge of a rotating blade array and the forward edge of the next adjacent stationary blade array proceeding in a direction toward successively lower pressures of the motive steam. The orifice inlet communicates through a circumferentiallyvarying throat leading to a diffusing passage with an extraction manifold disposed circumferentially about the casing. The axis of the passage is skewed at a predetermined angle with the axis of the turbine. Connected to the extraction manifold is an extraction pipe of a predetermined cross-section area which conducts steam extracted from the blade path through the orifice, inlet, throat, passage, and into the manifold and through the pipe to the associated user apparatus. The throat and the manifold are sized and interrelated such steam is extracted from the blade path in a circumferentially uniform manner. The dimension of the throat varies from the predetermined maximum to a predetermined minimum value in a plane containing the axis of the shaft. The radial dimension of the manifold varies from a radial maximum to a radial minimum value, in a plane perpendicular to the axis of the shaft, with the largest dimension of the throat being located circumferentially adjacent to the smallest radial dimension of the extraction manifold. The coincidence of the largest dimension of the throat and the radially smallest dimension of the manifold occurs approximately 180 degrees from the point of communication between the manifold and the extraction conduit. Thus, steam is extracted from the blade path to the extraction manifold in a manner which prevents the formation of large pressure differences in the cover as opposed the base of the apparatus. The arrangement described herein also eliminates losses generated by prior art extraction systems so as to make the extraction system, and hence the overall power plant, more efficient.

It is the object of this invention to provide an extraction system for a steam turbine power plant which uniformly extracts motive fluid from the cover and base areas of the blade path to eliminate cyclic stress imposed on rotor blades to improve the life and reliability of these blades. It is a further object of this invention to provide an efficient extraction system which increases the overall operating efficiency of the power plant through the expedient of eliminating losses occasioned by the use of prior art systems. The extraction system disclosed herein which also has as an object the elimination of extraction losses within the turbine so that steam is extracted from the blade path to the manifold with the minimum of pressure loss. Further, an object of this invention is to eliminate losses associated with the transport of the extracted steam to the user apparatus. Other objects of the invention will become clear in the detailed description of the preferred embodiment which follows herein.

BRIEF DESCRIPTION OF THE DRAWINGS

The invention will be more fully understood from the following detailed description of the preferred embodiment thereof, taken in connection with the accompanying drawings, in which.

DESCRIPTION OF THE PREFERRED EMBODIMENT

Figure 1:
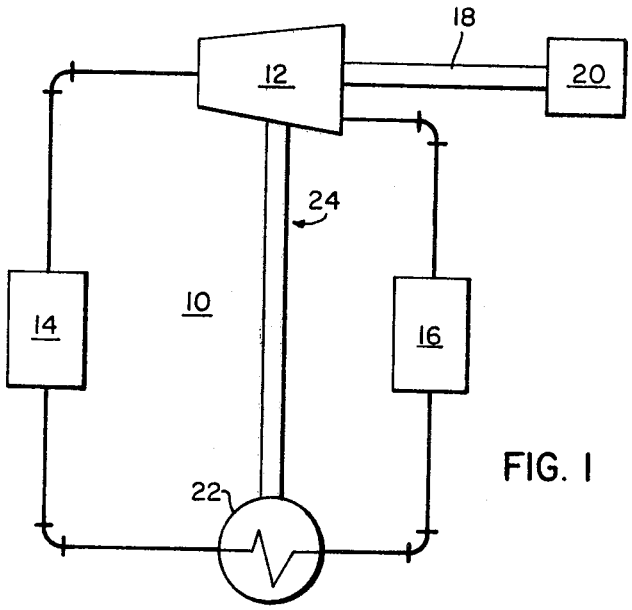
FIG. 1 is a schematic diagram of a typical steam turbine power plant in which an extraction system embodying the teachings of this invention is disposed.

Throughout the following description similar reference numerals refer to similar elements in all Figures of the drawings.

In FIG. 1, a schematic diagram of a steam turbine power plant, generally indicated by reference numeral 10, is shown to comprise a steam turbine element 12 connected in series between a steam generator element 14 and a condenser element 16. The shaft 18 of the turbine 12 is connected to an electrical generator 20 which provides electrical power to an associated electrical load (not shown).

Motive steam emerges from the steam generator element 14 and is permitted to expand through alternating arrays of stationary and rotating blades within the turbine element 12 in order to convert the energy of the motive steam to rotational mechanical energy to turn shaft 18 and generate electrical energy. The steam is exhausted from the turbine 12 into the condenser 16 and restored to the liquid state prior to its reentry into the steam generator 14 to complete the closed loop power plant arrangement 10.

It has been found that the overall efficiency of the power plant 10 may be enhanced and rendered more economical if there is disposed within the portion of the loop between the condenser 16 and the steam generator element 14 a suitable heater element 22 for the purpose of raising the temperature of the feedwater prior to its reintroduction into the steam generator element 14. The heat source for the feedwater heater 22 is steam extracted from predetermined locations within the turbine element 12 and it is for this purpose that an extraction system 24 (best shown in FIGS. 3 and 4) embodying the teachings of this invention is disposed with the steam turbine element 12. It is to be noted that steam may be extracted from locations within the turbine 12 for use in other, unmentioned, associated user apparatus within the power plant 10 which have been omitted here for clarity. It is also to be understood that steam may be extracted from several distinct locations within each turbine 12 and that the extraction system embodying the teachings of this invention is equally applicable for the extraction of steam of any predetermined location within the steam turbine for use in any associated user apparatus disposed within or without the power plant 10.

As discussed above, the prior art utilizes a variety of extraction systems, the most common of which is simply to dispose an opening at the appropriate location within the turbine from which steam possessing the particular pressure and temperature characteristics desired is to be extracted. Other arrangements in the prior art dispose a circumferential collector, or manifold around an extraction orifice at the predetermined location within the turbine and communicate this collector to the extraction pipe. However, the extraction manifold of the prior art is constricted radially inward along the horizontal centerline of the casings of the turbines, which constriction effectively inhibits communication between the upper and lower volumes within the manifold. In any case, however, the net result of either prior art construction is the generation of cyclic forces which are imposed upon the array of rotating blades disposed immediately axially upstream of the extraction point and also upon blade arrays downstream of the extraction.

Figure 2:
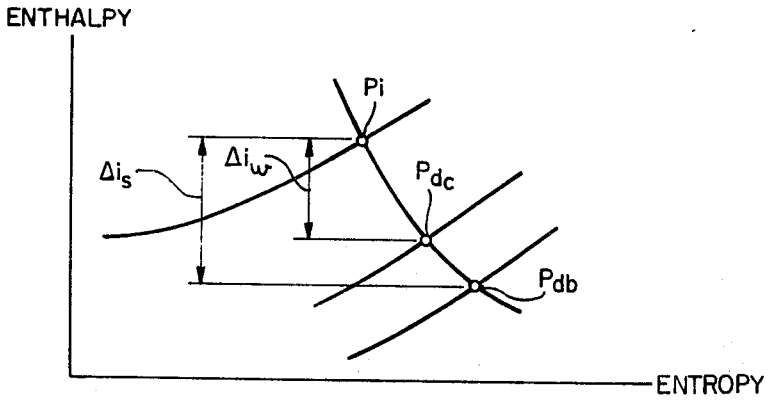
FIG. 2 is a graphical depiction showing the source of cyclic forces imposed on the prior art rotating blades.

With reference to FIG. 2, which is a graphical depiction of the situation extant in a prior art turbine apparatus, the underlying principle explaining the phenomena which results in the cyclic blade loading may be easily understood. As there seen, steam directed upon the rotating array in question emanates from the next axially upstream array of nozzle blades having a predetermine pressure, Pi. Steam from the upstream nozzle array exhibits a uniform pressure characteristic around the entire circumference of the annular blade path. Due to the construction of the extraction system in the prior art, it is empirically verifiable that a large portion of the extraction flow taken from the blade path is extracted from the base portion of the casing. As a result, large pressure variations are generated between static pressure upstream of the blade in question and the static pressure in the turbine cover downstream of the rotating blade row in question. Also, large pressure differences are generated between the static pressure upstream of the rotating blade in question and the static pressure in the base of the turbine downstream of the blade in question. Thus, the pressure on the downstream side of the rotating blades in the cover, as indicated as $P_{dc}$ in FIG. 2 is greater than the pressure downstream of the rotating blade row in the base, depicted in FIG. 2 as $P_{db}$. Shown graphically, the energy available in the flow entering the rotating array, $\Delta i_s$, is greater than the energy converted thereby to work, $\Delta i_w$.

It may thus be unreadily understood that the rotating blade is exposed to a static pressure difference while in the cover portion of the casing that is less than the static pressure difference to which blades are exposed while rotating in the base. The pressure imbalance leads to a cyclic force loading on the rotating blades which generates a high failure possibility and makes blades operating in this array more unreliable.

The large difference in steam volume extracted from the base, as opposed to the cover, also creates pressure vortices and crossflows in the flow path downstream of the rotating blade row which generate losses which cannot be recouped in subsequent expansion stages. Thus, the efficiency of the turbine is impaired, detracting from the overall efficiency of the power plant. Also, losses are imposed by the structure of the extraction system itself, further degrading the operating efficiency of the plant.

Figure 4:
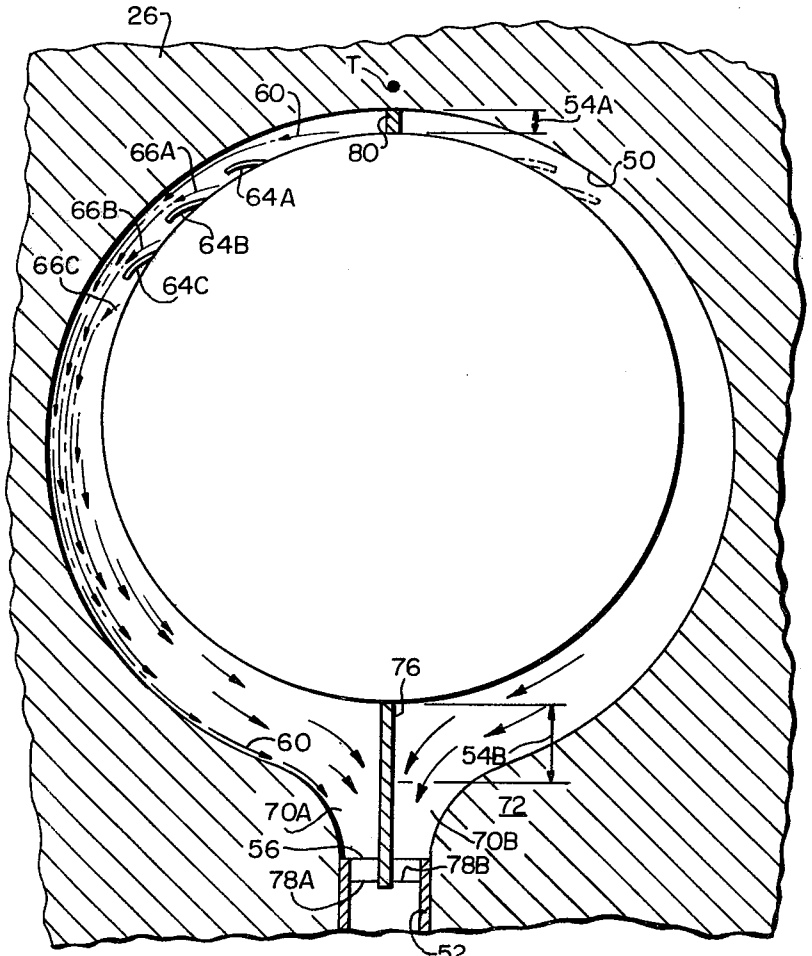
Figure 3:
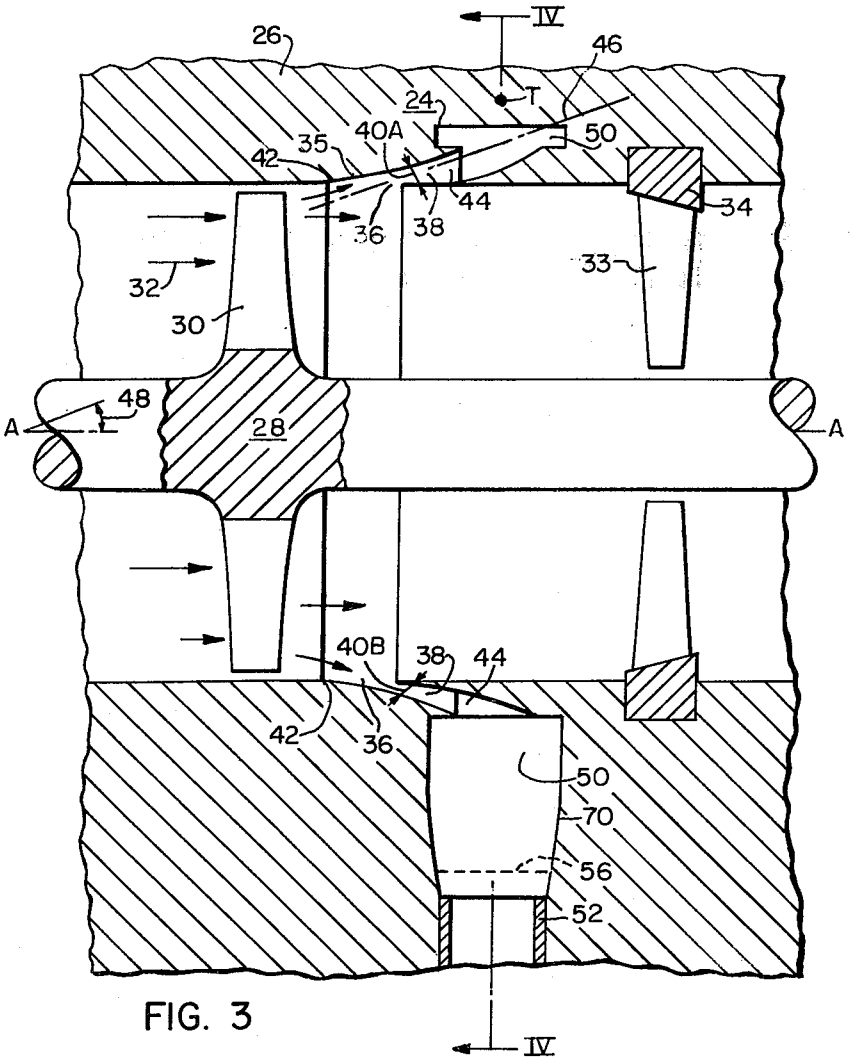
FIG. 3 is a longitudinal elevational view, in section, of an axial flow turbine apparatus having an extraction system embodying the teachings of this invention; and, FIG. 4 is a transverse section view taken along lines IV—IV of FIG. 3 showing an axial flow turbine apparatus having an extraction system embodying the teachings of this invention.

Referring now to FIGS. 3 and 4, longitudinal elevation and transverse elevation views, respectively, of the extraction system 24 embodying the teachings of this invention and which overcomes the aforementioned difficulties of the prior art is illustrated. It is to be understood that the arrangements shown in FIGS. 3 and 4 are highly stylized for clarity in presenting the inventive concepts of applicant's system. Thus, it is understood that the relative spacing shown between other turbine elements is distorted and exaggerated.

As seen in FIG. 3, the turbine 12 includes a casing 26 surrounding a rotor member 28 rotating on an axis of rotation A-A and upon which is mounted a plurality of annular arrays of rotating blades, one such array 30 being illustrated. Axially downstream, in the direction of flow 32, is an array of nozzle blades 33 which extend radially inward from the casing 26 and depend therefrom by means of a suitable attachment ring 34. The rotating blades 30 and the nozzles 33 combine to define an annular blade path within the casing 26.

The extraction system 24 is located axially intermediate the rotating array 30 and the stationary nozzle array 33 and comprises an extraction orifice, or slot, generally indicated at 35 which extends circumferentially about the interior of the casing. The slot 35 includes an inlet opening 36 which communicates directly with a throat portion 38 having a predetermined dimension 40 associated therewith. The dimension 40 of the throat 38 varies from the largest dimension 40A to the smallest dimension 40B as one proceeds in a circumferential direction about the casing 26. The axial dimension of the inlet opening 36 remains substantially constant about the circumference of the casing 26. The leading, or upstream, edge 42 of the inlet 36 is rounded to extract steam flow with a minimum energy loss.

Communicating with the throat 38 is a diffusing passage indicated by reference numeral 44 and shown to be of the converging-diverging type, although any configuration of the passage 44 may be used. The area ratio of the diffusing passage 44 varies circumferentially, with relatively little diffusing occurring in regions of large throat dimensions, and increasing diffusing occurring with smaller throat dimension. An axis 46 extending through the diffusing passage 44 is shown to define a predetermined angle 48 with the axis of rotation A—A of the turbine 12. The angle 48 is chosen so as to take advantage of the carryover of the axial velocity component of the steam within the blade path in order to reduce pressure loss in steam extraction. In the prior art, as discussed above, the extraction orifice is disposed perpendicular to the axis of rotation A—A of the turbine, thus creating undesirable vortex effects which detract from the efficiency of the turbine. The angle 48 may be any convenient angle so that the velocity component of steam in the streamline flow pattern in the flow path may be carried over into the extraction system with minimum energy loss.

Communicating with the diffusing passage 40 is an extraction collector, or manifold 50 disposed circumferentially about the interior of the casing 26. The manifold 50 is attached to an extraction pipe 52 which conducts elastic fluid extracted from the turbine 12 by the extraction system 24 to the associated user apparatus.

As best seen in FIG. 4, the manifold 50 has a radial dimension 54 in the transverse plane that extends from a smallest dimension 54A to a largest radial dimension 54B. As seen in FIGS. 3 and 4, the radial dimension of the manifold increases from the dimension 54A as one proceeds circumferentially in both a counterclockwise and clockwise direction from a point T on the circumference of the manifold 50 toward the predetermined point of attachment 56 at which the manifold 50 is connected with the extraction pipe 52. The manifold may, however, be maintained at a constant radial dimension. However, as explained herein, more efficient extraction is obtained if the radial dimension 54 of the manifold 50 varies in relation to the dimension 40 of the throat 38.

As stated, the throat 38 has a predetermined dimension 40 which varies from the largest dimension 40A to the smallest dimension 40B. An extraction system embodying the teachings of this invention exhibits the characteristic that the circumferential point at which the largest dimension 40A of the extraction throat 38 occurs is circumferentially opposite from the point of attachment 56 of the pipe 52 to the manifold 50. Conversely, the point of minimum dimension 40B of the throat 38 occurs at a point circumferentially adjacent to the point of attachment 56 of the pipe 52 to the manifold 50. Such a relationship between the dimension of the throat 38 and the attachment 56 between the manifold 50 and the pipe 52 insures that steam is extracted from the blade path in a circumferentially uniform manner to thereby eliminate pressure distortions and deviations common to prior extraction systems. It is also to be noted that since there is no radial construction of the manifold 50 adjacent the centerline of the casing 26 the prior art deficiency of extracting the greater volume of steam from the volume of the blade path proximate to the extraction pipe 52 is avoided.

Since the pressure distribution immediately downstream of the rotating blade 30 is equal throughout the circumference of the blade path annulus, it would follow that steam is more prone to flow through the largest throat opening 40A than through the smallest opening 40B if only this structural fact were considered. However, referring to FIG. 4, it is also seen that steam extracted through the largest throat opening 40A, located near point T on the casing 26, must flow within the manifold 50 through approximately 180 degress therewithin to the extraction pipe 52, as illustrated by hypothetical path 60 in FIG. 4. Fluid frictional forces within the manifold 50 thus mediate and modify the tendency that steam exits in greater quantities through the largest dimension 40A of the throat 38 since that steam, in order to reach the extraction pipe 52, must flow 180 degress within the manifold 50. Conversely, although steam extracted from the lower portion of the turbine blade path through hypothetical flow path 62 encounters less fluid friction than steam taking the flow path 60, such steam particles must negotiate the narrowest throat dimension 40B. Thus, the net overall effect of providing the above-defined interrelationship between the dimension 40 of the throat 38 and the location of the largest throat dimension opposite the attachment 56 between the manifold 50 and the extraction pipe 52 is that steam is extracted uniformly about the circumference of the blade path with minimum loss. It is to be understood, however, that criticality most attaches to the provision of the largest dimension 40A of the throat 38 at a point on the blade path that is circumferentially most distant from the point of attachment 56 of the extraction pipe 52 to the manifold 50, and, to the provision of the narrowest dimension 40B of the throat 38 circumferentially closest to the point of attachment 56. This disposition, when combined with fluid frictional effects in the manifold 50 results in a circumferentially uniform extraction flow from the blade path.

The precise size of the throat 40, in numerically quantifiable terms, is dependent upon a variety of factors which can be easily ascertained once a particular power plant arrangement is defined. For example, given a predetermined heat balance derivable from a particular steam power plant arrangement, the amount of steam flow required to be extracted from the turbine at a particular pressure and a particular temperature can be ascertained. Imposing thereon the condition that the flow is to be extracted uniformly about the circumference of the blade path and further adding the condition that the velocity of the steam so extracted within the extraction manifold is to be held below a predetermined value (in order to reduce fluid losses) the precise size of the throat may be determined by an analytical evaluation of the fluid losses. Through the application of this analytical method, the throat dimension at any circumferential location is chosen so that the total fluid loss between the adjacent blade path flow and the extraction pipe connection is a uniform value. In practice, the fluid losses may be obtained by the application of empirical methods such as are given in Reference (SAE Aerospace Applied Thermodynamics Manual), October, 1969, to obtain individual elements of the total loss associated with various geometrical features of the flow path followed by the extracted steam up to the extraction pipe connection.

To further increase extraction efficienty, it has been found that more efficient conduction of the uniformly extracted steam from blade path can be effected if the cross-section area of the manifold 50 is greater than the cross-section area of the throat 38. Put another way, when valued as a function of the cross-section area of the extraction pipe 52, a manifold cross-section area equal to approximately 120% of the extraction pipe area, and a throat area approximately 90% of the extraction manifold area, is beneficial. In this manner, uniform extraction can be implemented by an extraction system embodying the teachings of this invention with manifold flow disturbances kept to a minimum.

There may also exist an interrelationship between the dimension 40 of the throat 38 and the radial dimension 54 of the manifold 50. It is desirable and the preferred embodiment of the invention that the point at which the largest dimension 40A of the throat 38 occurs is circumferentially coincident with the point at which the minimum radial dimension 54A of the manifold 50 occurs, that is, adjacent the point T. Also, the point at which the minimum dimension 40B of the throat 38 occurs is circumferentially coincident with the point at which the maximum radial dimension 54B of the manifold 50 occurs, i.e., at a point circumferentially adjacent to the point of attachment 56 of the manifold 50 to the extraction pipe 52.

This radial variation in dimension of the manifold 48 in relation to the throat size assists in the efficient extraction of steam. As seen in FIG. 4, as one proceeds circumferentially from the point T toward the attachment point 56, due to the uniform extraction characteristic generated by the circumferentially varying dimension of the thrroat 38, more and more extraction steam is conducted into the manifold 50 as the circumferential distance from the point T toward the point 56 increases. In order to minimize or eliminate would-be deleterious fluid friction and vortex effects within the manifold 50, the radial dimension 54 of the manifold 50 increases to permit the greater and greater volumes of steam to enter the manifold 50 as the circumferential distance from the point T increases.

To still further increase the efficiency of the extraction system, a plurality of turning vanes 64 are disposed at varying circumferential locations within the manifold 50. The turning vanes 64 are used to direct fluid extracted from predetermined circumferential locations within the blade path to be more efficiently integrated within the extraction flow within the manifold 50. Thus, for example, referring to FIG. 4, turning vane 64A is oriented such that steam extracted from the portion of the blade path adjacent the vane 64A is directed and flows within the manifold 50 along a hypothetical flow pattern 66A. Similarly, the turning vanes 64B and 64C are oriented so that flows extracted from the portion of the blade path adjacent these turning vanes are directed into the manifold 50 and follow hypothetical flow patterns 66B and 66c, respectively. In this manner, pressure drop due to impingement of extraction steam particles within the radially-increasing manifold 50 are reduced, which further increases the efficiency of the extraction system embodying the circumferentially varying extraction thraot dimension 40 as taught by this invention.

To even still further increase flow efficiency within the extraction manifold 50, portions of the manifold circumferentially adjacent to the point 56 of attachment with the pipe 50 are arranged so as to provide conical diffusing channels 70A and 70B in a transition region 72 adjacent the point of attachment 56 between the manifold 50 and the extraction pipe 52. Such provision again enhances the flow characteristics within the manifold 50 and extraction pipe 52 to further reduce pressure drop of extracted steam to the associated user apparatus by reducing inlet losses at the entrance of the extraction pipe 52.

In order to even further avoid pressure losses, eliminate vortex patterns and to change the frequency of the steam within the manifold to prevent the generation oscillatory column therewithin, a radially extending baffle plate 76 is provided and extends radially, relative to the turbine's centerline A—A, through the manifold 50. As seen, the baffle 76 extends into a portion of the extraction pipe 52. It is noted, as seen in FIG. 4, the cross-section area 78A and 78B between the walls of the extraction pipe 52 and the baffle 76 are equal. A second baffle member 80 may be provided in the region adjacent the point T to prevent vortex interaction between extracted steam taken from this circumferential region of the blade path.

It may be thus seen that by provision of an extraction system having a throat dimension that varies circumferentially as one proceeds from a point opposite the extraction pipe connection toward the pipe connection develops a uniform extraction pattern. To optimize the efficiency of the system, provision of an extraction manifold geometry that exhibits an area that is at all times greater than the area of the extraction orifice and an interrelationship between manifold radial dimension and the throat dimension results in efficient flow in the manifold to eliminate pressure losses. The provision of turning vane structures, baffle plates and transition regions still further optimizes the flow from the manifold into the extraction pipe to the user apparatus.

From a consideration of the factors above discussed, it may be readily appreciated that an extraction system embodying the teachings of this invention uniformly extracts steam from the circumferential blade path. As a further feature, removal of moisture from the radially outermost portion of the entire annulus of the blade path is effected by an extraction system embodying the teachings of the invention. As is known, prior art systems are unable to remove efficiently entrained moisture within the steam flow in the turbine cover. Further, extraction pressure drops from blade path to the associated user apparatus are decreased, to thus increase the heat rate for the overall power plant and, therefore, the overall efficiency thereof. It has been anticipated that a substantial improvement in pressure drop between the blade path and the associated user element can be provided with an extraction system embodying the teachings of this invention. Such improvements reflect favorably in regard to the economics of power plant operation.

Other advantages of the system embodying the teachings of this invention over the prior art include uniform loading across the entire circumference of a given row of rotating blades, thus permitting higher blade loading for a particular expansion stage, and, longer reliability of turbine blade components. It is to be noted that a system operating and employing the teachings of this invention permits a uniform extraction over the entire circumference of the blade path over a load range from maximum rating down to 30% of load. It is also to be noted that experimental techniques have established that a stage following the extraction zone is not to be effected deleteriously until extraction decreases the turbine flow 32 to approximately 30 to 40% of rated flow. Yet further, provision of the extraction system taught herein results in the uniform elimination of the boundary layer along the radially outermost portion of the blade path. The elimination of this boundary layer about the entire annulus of the blade path serves to enhance efficiency of the stages downstream of the extraction zone.

Thus it may be readily seen that an extraction distance of this type at once eliminates all of the disadvantages inherent in the prior art system and increases the efficiency of power plant employing the system embodying the teachings of this invention.

It is, of course, understood that the foregoing description has been presented only to illustrate and describe the principles of the invention. Accordingly, it is desired that the invention not be limited by the embodiment described, but rather that it be accorded an interpretation consistent with the scope and spirit of its broad principles.

I claim as my invention:

1. An extraction system for extracting steam at a predetermined pressure from a steam turbine apparatus for use within an associated user apparatus in a circumferentially uniform manner, the turbine having a rotor with an axis therethrough with a plurality of arrays of rotating blades thereon, a casing disposed circumferentially about said rotor, a plurality of arrays of stationary blades dependent from the casing and alternately disposed axially between adjacent arrays of rotating blades, the alternating arrays of stationary and rotating blades cooperating to define an annular blade path, the extraction system comprising:

an extraction orifice extending circumferentially about the casing, said orifice being disposed axially intermediate an array of rotating blades and the next-axially adjacent array of stationary blades, the orifice having an inlet opening communicating with a throat portion, the throat portion having a dimension that varies from a maximum to a minimum dimension about the circumference of the blade path, an extraction manifold disposed circumferentially about the casing and communicating with the extraction throat, and, an extraction pipe connecting the extraction manifold to the associated user apparatus, the dimension of the throat being sized so that the maximum throat dimension occurs at the point on the circumference of the blade path circumferentially opposite the point of attachment of the manifold with the extraction pipe.

2. The extraction system of claim 1 in which the radial cross-section of the manifold is, at all circumferential points, greater than the axial area of the extraction orifice.

3. The extraction system of claim 1 wherein:

the manifold has a dimension in a plane normal to the axis varying circumferentially within a predetermined range of dimensions from a smallest radial dimension to a largest radial dimension, the smallest radial dimension of the manifold being circumferentially coincident with the maximum dimension of the throat, the largest radial dimension of the manifold being circumferentially coincident with the minimum dimension of the throat, the extraction pipe being connected to the manifold adjacent the circumferential location of the blade path where coincidence between the minimum dimension of the throat and the largest radial dimension of the manifold occurs.

4. The extraction system of claim 3 wherein:

a transition region is disposed between the manifold and the extraction pipe, the transition region defining a conical diffusion passage.

5. The extraction system of claim 3 wherein:

a diffusing passage is disposed between the throat portion and the manifold, the passage being in fluid communication with both the blade path from which steam is extracted and the manifold.

6. The extraction system of claim 5 wherein said diffusing passage is a converging-diverging passage.

7. The extraction system of claim 5 wherein an axis extends through the diffusing passage, the axis being inclined at a predetermined angle relative to the axis of the turbine.

8. The extraction system of claim 3 wherein:

a first baffle member is disposed within the manifold where the manifold communicates with the extraction pipe, the first baffle member extending in a radial plane relative to the axis of the turbine.

9. The extraction system of claim 3 wherein:

a baffle member is disposed in the manifold at the smallest radial dimension thereof, the baffle being disposed in a radial direction relative to the axis of the turbine.

10. The extraction system of claim 3 wherein a plurality of turning vanes are disposed within the manifold at predetermined circumferential locations thereon so as to integrate steam extracted from circumferential portions of the blade path adjacent said vanes with steam taken from other circumferential portions of the blade path without the generation of vortices within the manifold.

11. The extraction system of claim 8, wherein said first baffle member extends a predetermined distance into the extraction pipe.

12. The extraction system of claim 8, wherein a second baffle member is disposed in the manifold at the smallest radial dimension thereof, and, wherein a second baffle member is disposed in the manifold at the smallest radial dimension thereof, and, wherein said first baffle member extending a predetermined distance into said extraction pipe.

13. The extraction system of claim 12, wherein, a plurality of turning vanes are disposed within the manifold at predetermined circumferential locations thereon so as to integrate steam extracted from circumferential portions of the blade path adjacent said vanes with steam taken from other circumferential portions of the blade path without the generation of vortices within the manifold.

* * * * *